US005102766A

United States Patent [19]

Nanya et al.

[11] Patent Number: 5,102,766

[45] Date of Patent: Apr. 7, 1992

[54] TONER FOR DEVELOPING LATENT ELECTROSTATIC IMAGES

[75] Inventors: Toshiki Nanya, Mishima; Kimitoshi Yamaguchi; Hiromitsu Kawase, both of Numazu; Makoto Ookawara, Tokyo, all of Japan

[73] Assignee: Ricoh Company, Ltd., Tokyo, Japan

[21] Appl. No.: 496,458

[22] Filed: Mar. 20, 1990

[30] Foreign Application Priority Data

Mar. 24, 1989 [JP] Japan ..... 1-070586
May 22, 1989 [JP] Japan ..... 1-126571

[51] Int. Cl.[5] ..... G03G 9/097
[52] U.S. Cl. ..... 430/110
[58] Field of Search ..... 430/110

[56] References Cited

U.S. PATENT DOCUMENTS 3,796,664 2/1974 Hayashi et al. ..... 430/109 X
3,948,654 4/1976 Fisher ..... 430/125
4,294,904 10/1981 Mammino ..... 430/110 X
4,403,027 9/1983 Ishitawa ..... 430/137
4,411,974 10/1983 Lu ..... 430/106

*Primary Examiner*—Roland Martin
*Attorney, Agent, or Firm*—Cooper & Dunham

[57] ABSTRACT

A toner for developing latent electronstatic images comprises a coloring agent, a binder resin component and a negative charge controlling agent in an effective amount which is selected from the group consisting of:

(i) an aromatic fluoride having formule (I);

(I)

(ii) an aromatic fluoride having formula (II);

(II)

(iii) an aromatic fluoride having formula (III);

(III)

(iv) an aromatic fluoride having formula (IV); and (IV)

(v) an aromatic fluoride having formula (V).

(V)

wherein $R^1$ to $R^8$, $R'^1$ and $R'^2$, n, X and Y are the same as previously defined in the specification.

14 Claims, 1 Drawing Sheet

FIGURE
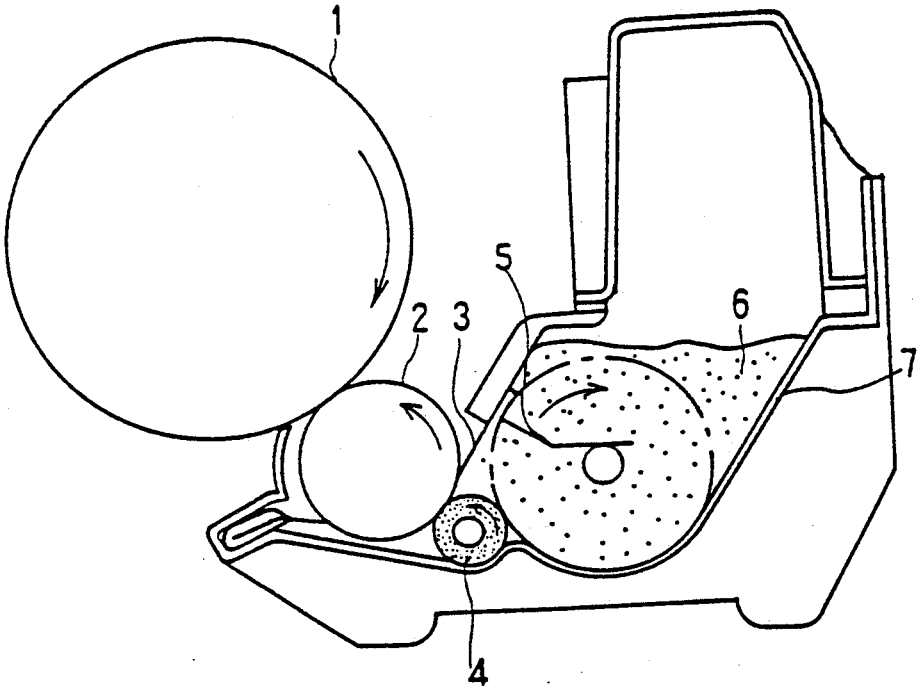

TONER FOR DEVELOPING LATENT ELECTROSTATIC IMAGES

BACKGROUND OF THE INVENTION

1. Field of the Invention

The present invention relates to a toner for developing latent electrostatic images. In particular, it is concerned with a negatively chargeable toner used in the field of electrophotography and electrostatic printing.

2. Discussion of Background

For developing latent electrostatic images to visible images there are two types of a developer, as conventionally disclosed in Japanese Laid-Open Patent Application 61-147261. One is a two-component type developer prepared by mixing toner and carrier particles, and the other is a one-component type developer which is obtained by dispersing a coloring agent such as a dye and a pigment in a binder resin without using carrier particles.

In the aforementioned two-component type developer, toner particles and carrier particles are electrically charged to different polarities in the course of stirring in a development unit, and the toner particles are attracted to latent electrostatic images which are charged to an opposite polarity to that of the toner particles and visible toner images can be thus obtained. The method of developing latent electrostatic images to visible toner images varies depending on the types of the employed carrier particles. For example, in the magnetic brush development, toner particles are mixed together with iron powders serving as carrier particles, and in the cascade development, toner particles are attracted to the surfaces of glass beads serving as carrier particles by the aid of a triboelectric effect. In addition, fur brush development can be carried out by using a fur brush instead of carrier particles.

In the case of a one-component type developer, various development methods are also proposed. For example, powder cloud development, one of the aerosol development methods, is conducted by spraying the one-component type developer to a transfer sheet bearing latent electrostatic images and contact development, also referred to as touch down development, is conducted in such a manner that toner particles are directly brought into contact with latent electrostatic images. There is also proposed an induction development, in which magnetic electroconductive toner particles are brought into contact with latent electrostatic images.

The toner particles applicable for the above-mentioned development methods are prepared by dispersing a coloring agent such as carbon black in a binder resin such as natural resins and synthetic resins. More specifically, a coloring agent is dispersed in a binder resin such as polystyrene, the resulting dispersion is cooled to room temperature to prepare a solid material, and then it is pulverized until a particle diameter thereof will attain to 1 to 30 $\mu$m. Furthermore, by adding a magnetic material such as magnetite to the above-mentioned coloring agent and binder resin, a magnetic toner can be obtained.

As previously mentioned, toner particles applicable for various development methods are electrically charged to a positive or negative polarity depending on the polarity of the latent electrostatic image. Toner particles can be provided with the electric charge by means of the triboelectric characteristics of a resin component contained therein. In such a case, however, the chargeability of toner particles is not so sufficient that the fogging will easily occur on the obtained images, which deteriorates the sharpness of images.

To give the desired chargeability to toner particles, a dye or pigment capable of providing toner particles with electric charge, or a charge controlling agent is generally added to toner particles.

For charge controlling agents which apply a negative charge to the toner, metal complex salts of monoazo dye; nitrofumic acid and salts thereof; Co, Cr and Fe metal complexes containing salicylic acid, naphthoic acid or dicarboxylic acid; sulfonated copper phthalocyanine pigment; a nitro group- or halogen-introduced styrene oligomer; chlorinated paraffin; and melamine resin can be employed.

However, the above-mentioned dyes capable of applying a negative charge to the toner have the shortcomings that their structures are complicated and characteristics are unstable, so that the stability cannot be ensured as the charge controlling agent. In addition to this, they are easily decomposed while kneaded with application of heat thereto, and decomposed or deteriorated by mechanical shocks, frictions, and changes in temperature and humidity conditions. This will be accompanied by the deterioration of charge controllability. Some of the above dyes serving as charge controlling agent may change their charge controlling performance in accordance with the environment.

Furthermore, when toner particles containing the conventional charge controlling agents are practically used for a long period of time, the charge controlling agents are separated from the toner particles due to the friction between toner particles and between the toner particles and the surface of a photoconductor, and the collision of the toner particles with carrier particles. The charge controlling agents which have been separated from the toner are deposited to the surface of the photoconductor, with the result that a so-called toner-filming phenomenon takes place.

SUMMARY OF THE INVENTION

Accordingly, an object of the present invention is to provide a toner for developing latent electrostatic images, which is (a) capable of keeping the triboelectric performance constant between toner particles and between toner particles and carrier particles, or between toner particles and charge application members such as a development sleeve and a development blade in the case where a one-component type developer is used; (b) producing sharp and even distribution of the amount of the triboelectric charge; and (c) controlling the chargeability to the employed development system.

A second object of the present invention is to provide a toner for developing latent electrostatic images, capable of yielding clear color images without deposition or stain of toner particles of the background of copying paper, and capable of yielding clear images without the decrease in image fidelity during the repeated operation.

The above-mentioned objects of the present invention can be achieved by a toner for developing latent electrostatic images comprising a coloring agent, a binder resin component and a negative charge controlling agent selected from the group consisting of aromatic fluorides having the following formulas (I) through (V):

(I)

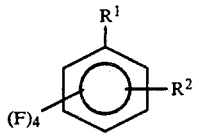

wherein $R^1$ represents a COOH group, CN group, F, Cl, $CONH_2$ group or $NHCOCH_3$ group; and $R^2$ represents H, OH group, $NH_2$ group, CN group, COOH group or Cl.

(II)

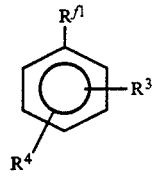

wherein $R^{f1}$ represents $C_nF_{2n+1}$ or $OC_nF_{2n+1}$, in which n is a positive integer; and $R^3$ and $R^4$ each represent H, Cl, Br, COOH group, $NH_2$ group, $CONH_2$ group, $CONH(CH_2)_2CH_3$ group, $NHCOCH_3$ group, CN group or $NO_2$ group.

(III)

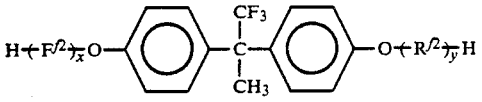

wherein $R^{f2}$ represents $C_nF_{2n}$, $OC_nF_{2n}$, $C_nH_{2n}$ or $OC_nH_{2n}$, in which n is a positive integer; and X and Y each represent a positive integer or zero.

(IV)

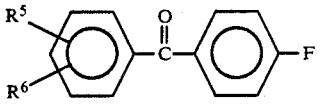

wherein $R^5$ represents H, Cl, Br, F, COOH, an alkyl group having 1 to 8 carbon atoms, a perfluoroalkyl group having 1 to 8 carbon atoms or a perfluoroalkoxyl group having 1 to 8 carbon atoms; and $R^6$ represents H, Cl, Br, a halogenated alkyl group having 1 to 8 carbon atoms, $NO_2$ or CN.

(V)

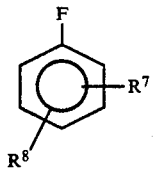

wherein $R^7$ represents H, Cl, Br, F, OH, $NH_2$, COOH, $CONH_2$, CN or $NO_2$; and $R^8$ represents H, Cl, Br, OH, $NH_2$, COOH, $CONH_2$, CN or $NO_2$.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

the single FIGURE is a schematic cross-sectional view of a development unit for use in the present invention.

DETAILED DESCRIPTION OF THE PREFERRED EMBODIMENTS

A toner for developing latent electrostatic images according to the present invention comprises a coloring agent, a binder resin component and a negative charge controlling agent selected from the group consisting of aromatic fluorides having the following formulas (I) through (V).

Specific examples of aromatic fluorides having formula (I), which are white or light-colored, are listed below:

I-(1)

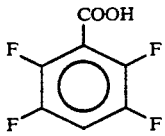

I-(2)

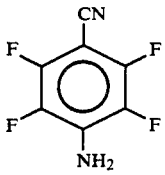

I-(3)

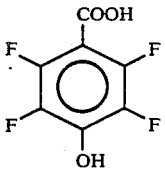

I-(4)

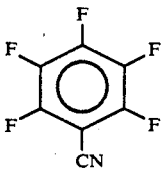

I-(5)

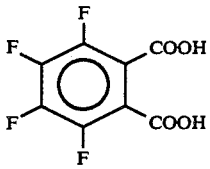

I-(6)

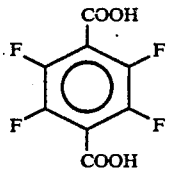

I-(7)

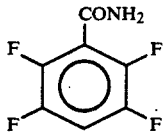

-continued
I-(8)
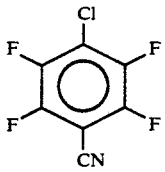
I-(9)
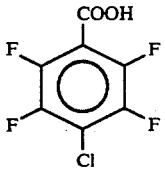
I-(10)
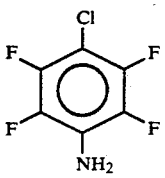
I-(11)
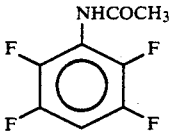
I-(12)
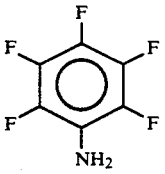
Specific examples of aromatic fluorides having formula (II), which are white or light-colored, are listed below:
II-(1)
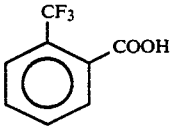
II-(2)
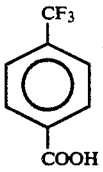
II-(3)
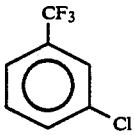
II-(4)
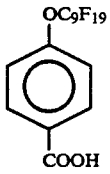
-continued
II-(5)
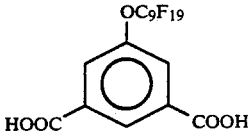
II-(6)
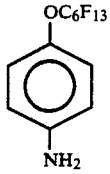
II-(7)
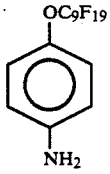
II-(8)
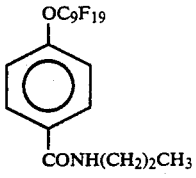
II-(9)
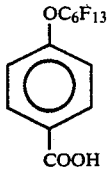
II-(10)
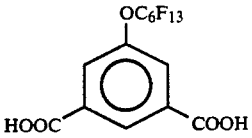
II-(11)
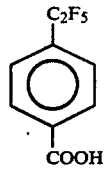
II-(12)
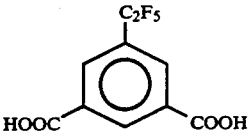
II-(13)
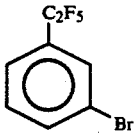
II-(14)
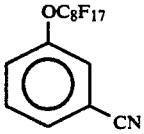

-continued
II-(15)
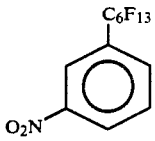
II-(16)
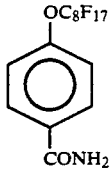
II-(17)
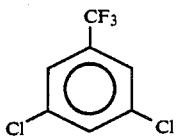
Specific examples of aromatic fluorides having formula (III), which are white or light-colored, are listed below:
III-(1)
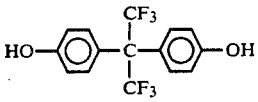
III-(2)
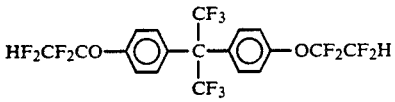
III-(3)
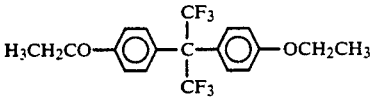
III-(4)
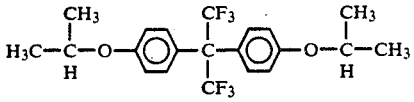
III-(5)
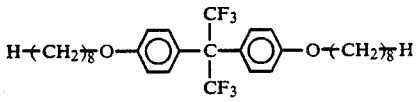
III-(6)
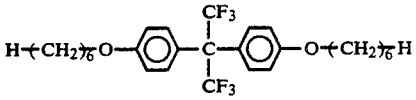
III-(7)
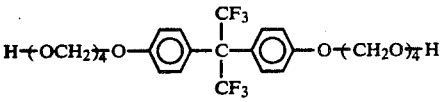
III-(8)
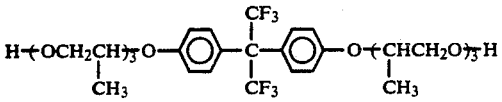
III-(9)
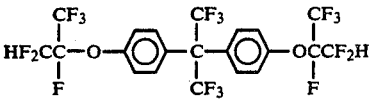
-continued
III-(10)
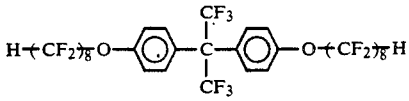
III-(11)
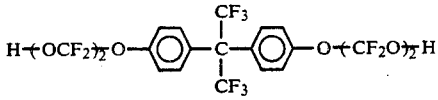
III-(12)
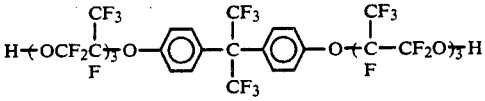
Specific examples of aromatic fluorides having formula (IV), which are white or light-colored, are listed below:
IV-(1)
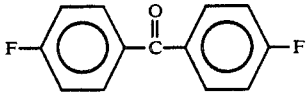
IV-(2)
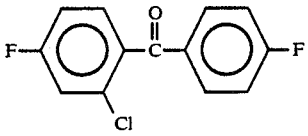
IV-(3)
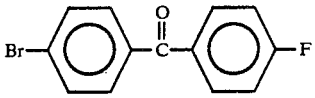
IV-(4)
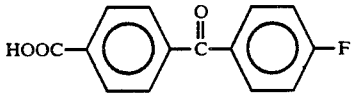
IV-(5)
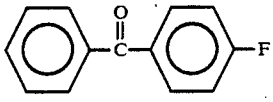
IV-(6)
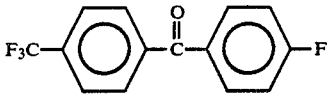
IV-(7)
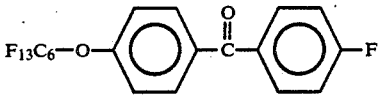
IV-(8)
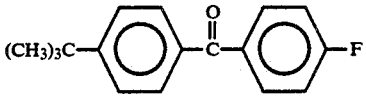
IV-(9)
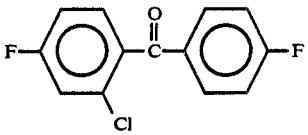

-continued

IV-(10)

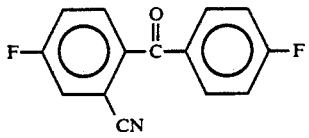

IV-(11)

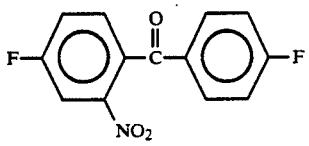

IV-(12)

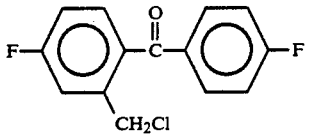

IV-(13)

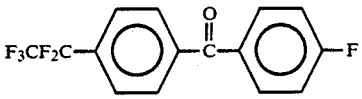

IV-(14)

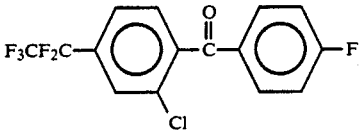

Specific examples of aromatic fluorides having formula (V), which are white or light-colored, are listed below:

V-(1)

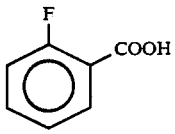

V-(2)

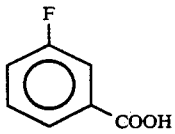

V-(3)

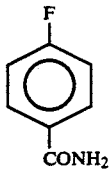

V-(4)

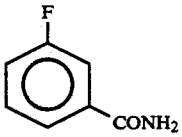

V-(5)

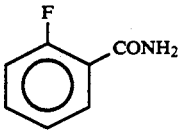

-continued

V-(6)

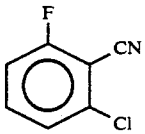

V-(7)

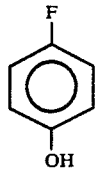

V-(8)

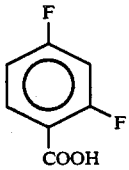

V-(9)

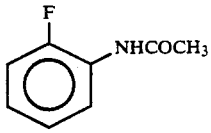

V-(10)

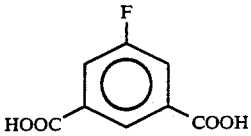

V-(11)

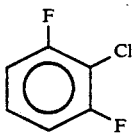

V-(12)

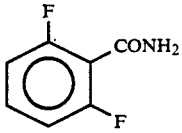

V-(13)

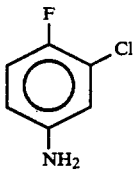

V-(14)

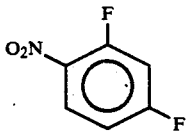

The amount of the aromatic fluoride selected from the above listed compounds having formulas (I) to (V) serving as a charge controlling agent in the present invention is determined in accordance with the type of a binder agent to be employed in combination, the presence of additives which may be used if needed, the preparation method of a toner including a dispersing manner of components. It is preferable that the amount of the above aromatic fluoride be in the range of 0.1 to 20 parts by weight to 100 parts by weight of the binder agent. Within the above-mentioned range, the negative charge quantity of the toner is proper. The thus negatively charged toner is applicable in the practical use, and at the same time, since the quantity of the electric charge is not too much, the electrostatic attraction between toner particles and carrier particles is not extremely increased. Accordingly, the fluidity of a developer thus obtained is not deteriorated and the image density is not decreased.

Examples of the binder agent for use in the present invention are homopolymers of styrene and styrene derivatives such as polystyrene, poly-p-chlorostyrene and polyvinyl toluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene acrylonitrile copolymer, styrene-vinylmethyl ether copolymer, styrene-vinylethyl ether copolymer, styrene-vinylmethylketone copolymer, styrene-butadiene copolymer, styrene-isopropylene copolymer, styrene-acrylonitrile-indene copolymer, styrene-maleic acid copolymer and styrene-maleate copolymer; and other resins such as polymethyl methacrylate, polybutyl methacrylate, polyvinyl chloride, polyvinyl acetate, polyethylene, polypropylene, polyester, polyurethane, polyamide, epoxy resin, polyvinyl butyral, polyacrylic acid resin, rosin, modified rosin, terpene resin, phenolic resin, aliphatic hydrocarbon resin, alicyclic hydrocarbon resin, aromatic petroleum resin, chlorinated paraffin and paraffin wax. Those can be used alone or in combination.

In particular, when a toner image formed on a transfer sheet is fixed with application of pressure thereto, preferable examples of the binder resin are as follows: polyolefin such as low molecular weight polyethylene, low molecular weight polypropylene, polyethylene oxide and polyethylene tetrafluoride; epoxy resin; polyester resin; styrene-butadiene copolymer (monomer ratio of 5 to 30:95 to 70); olefin copolymer such as ethylene-acrylic acid copolymer, ethylene-acrylate copolymer, ethylene-methacrylic acid copolymer, ethylene-methacrylate copolymer, ethylene-vinyl chloride copolymer, ethylene-vinyl acetate copolymer and ionomer resin; polyvinyl pyrrolidone; methyl vinyl ether-maleic anhydride copolymer; maleic acid modified phenolic resin and phenol modified terpene resin. Those can be used alone or in combination.

For the coloring agent for use in the present invention, any conventional dyes and pigments can be employed. Specific examples of the coloring agent are carbon black, lamp black, black iron oxide, ultramarine blue, nigrosine dye, aniline blue, phthalocyanine blue, phthalocyanine green, Hansa yellow G, rhodamine 6G lake, Calconyl Blue, chrome yellow, quinacridone, benzidine yellow, Rose Bengale, triallylmethane-type dyes, monoazo-type dyes and pigments, and disazo-type dyes and pigments. The above-mentioned conventional dyes and pigments can be used alone or in combination.

The toner according to the present invention is advantageous when used as a two-component type developer by blending this toner and carrier particles.

Any conventional carrier particles are available in the present invention. For example, magnetic finely-divided particles such as iron powders, ferrite powders and nickel powders; and glass beads and resin-coated glass beads can be employed as carrier particles.

Furthermore, the toner according to the present invention can be used as a magnetic toner by adding a magnetic material to the binder resin, coloring agent and charge controlling agent. Examples of the magnetic material contained in the toner according to the present invention are iron oxides such as magnetite, hematite and ferrite; metals such as iron, cobalt and nickel; alloys of the above-mentioned ferromagnetic metals and the following metals such as aluminum, cobalt, copper, lead, magnesium, tin, zinc, antimony, beryllium, bismuth, cadmium, calcium, manganese, selenium, titanium, tungsten and vanadium; and mixtures thereof. It is preferable that the average particle diameter of the above-mentioned magnetic material be about 0.1 to 2 $\mu$m.

The amount of the above magnetic material is preferably in the range of 20 to 200 parts by weight, and more preferably in the range of 40 to 150 parts by weight to 100 parts by weight of a resin component.

The toner according to the present invention can be used as a one-component type developer in a development unit as shown in the single FIGURE. In the development unit in the single FIGURE, a toner 6 accumulated in a toner reservoir 7 is forcibly brought onto a sponge roller 4 by a stirring blade 5, so that the toner 6 is supplied onto the sponge roller 4. As the sponge roller 4 is rotated in a direction of the arrow, the toner 6 fed to the sponge roller 4 is transported onto a toner transportation member 2, where the toner 6 is frictioned, and electrostatically or physically attracted to the toner transportation member 2. As the toner transportation member 2 is rotated counterclockwise, a uniformly thin layer of the toner 6 is formed on the toner transportation member 2 by an elastic blade 3. At the same time, the thin layer of the toner 6 is triboelectrically charged. The toner 6 is then transported onto the surface of a latent electrostatic image bearing member 1 which is situated in contact with or adjacent to the toner transportation member 2, so that the latent electrostatic image is developed to a visible toner image.

To the toner according to the present invention, other auxiliary agents may be added when necessary. For example, there are a lubricant such as Teflon and zinc stearate; an abrasive such as cerium oxide and silicon carbide; a fluidity providing agent or a caking inhibitor such as colloidal silica and aluminum oxide; an electroconductivity-imparting agent such as carbon black and tin oxide; and a fixing promoting agent such a low molecular weight polyolefin.

Other features of this invention will become apparent in the course of the following description of exemplary embodiments, which are given for illustration of the invention and are not intended to be limiting thereof.

EXAMPLE 1

The following components were mixed and stirred in a Henschel mixer, and then kneaded for about 30 minutes in a roll mill which was heated to 130° to 140° C. This mixture was cooled to room temperature, pulverized and classified, so that blue toner No. 1 with a particle diameter of 5 to 20 $\mu$m according to the present invention was obtained.

| | Parts by Weight |
|---|---|
| Crosslinked polyester resin | 100 |
| Polypropylene | 5 |
| C.I. Pigment Blue 15 | 5 |
| Aromatic fluoride (I)-1 | 1.5 |

2.5 parts by weight of the above prepared toner No. 1 and 97.5 parts by weight of silicone-resin-coated ferrite carrier particles having a particle size of 100 to 250 meshes were mixed in a ball mill, whereby a two-component type developer was obtained.

The thus obtained developer was subjected to an image formation test using a commercially available electrophotographic copying machine, "FT-4060" (Trademark), made by Ricoh Company, Ltd. The initial images obtained by the above test were clear. Even after 200,000 copies were made, the obtained images were still excellent in quality.

The initial charge quantity of the toner, measured by the blow-off method, was −19.1 μC/g. After the making of 200,000 copies, the charge quantity of the toner was −18.8 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

COMPARATIVE EXAMPLE 1

The same procedure for preparing the two-component type developer as employed in Example 1 was repeated except that the aromatic fluoride (I)-1 in the formulation of the toner in Example 1 was replaced by a commercially available zinc salt of salicylic acid, "E-84" (Trademark), made by Orient Chemical Industries, Ltd., whereby a comparative developer was obtained.

The thus obtained comparative developer was subjected to the same image formation test as conducted in Example 1. The initial images obtained by the above test were clear free from fogging. After 100,000 copies were made, however, obtained images became unclear and fogging was observed. In addition, there was a film of the toner formed on the photoconductor.

The initial charge quantity of the toner, measured by the blow-off method, was −12.8 μC/g. After the making of 100,000 copies, the charge quantity of the toner was decreased to −5.5 μC/g.

As a result of the image formation test under the conditions of high humidity of 90% RH at 35° C., the image density of obtained images was as low as 0.95 and images were unclear due to the fogging.

EXAMPLE 2

The following components were mixed and stirred in a Henschel mixer, and then kneaded for about 30 minutes in a roll mill which was heated to 130° to 140° C. This mixture was cooled to room temperature, pulverized and classified, so that red toner No. 2 with a particle diameter of 5 to 20 μm according to the present invention was obtained.

| | Parts by Weight |
|---|---|
| Styrene-2-ethylhexyl acrylate copolymer | 100 |
| Polypropylene | 5 |
| C.I. Pigment Red 57 | 5 |
| C.I. Pigment Red 48 | 3 |
| Aromatic fluoride (I)-2 | 2 |

100 parts by weight of the above prepared toner No. 2, 3 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to an image formation test using the development unit as shown in the single FIGURE. In this example, an electric charge of −800 volts d.c. was uniformly applied to an organic photoconductor 1, the photoconductor 1 was exposed to a light image to form a latent electrostatic image thereon, and the latent electrostatic image is developed to a visible toner image by the above prepared developer.

The initial images obtained by the above test were clear red. Even after 50,000 copies were made, the obtained images were still excellent in quality.

The initial charge quantity (Q/M) of the toner on the toner transportation member 2 as shown in the single FIGURE, measured by use of a specific charge quantity measuring apparatus, was −11.2 μC/g. In the above specific charge quantity measuring apparatus, the toner particles on the toner transportation member 2 were sucked by a Faraday cage with a filter layer equipped at an outlet thereof, and trapped therein to measure the charge quantity of the toner. After the making of 50,000 copies, the charge quantity of the toner was −10.5 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 3

The following components were mixed and stirred in a Henschel mixer, and then kneaded for about 30 minutes in a roll mill which was heated to 130° to 140° C. This mixture was cooled to room temperature, pulverized and classified, so that green toner No. 3 with a particle diameter of 5 to 20 μm according to the present invention was obtained.

| | Parts by Weight |
|---|---|
| Epoxy resin | 100 |
| Polyethylene | 5 |
| C.I. Pigment Blue 15 | 5 |
| C.I. Pigment Yellow 17 | 5 |
| Aromatic fluoride (I)-5 | 1.5 |

3.5 parts by weight of the above prepared toner No. 3 and 96.5 parts by weight of iron carrier particles having a particle size of 100 to 200 meshes were mixed in a ball mill, whereby a two-component type developer was obtained.

The thus obtained developer was subjected to the same image formation test as conducted in Example 1.

The initial images obtained by the above test were clear. Even after 200,000 copies were made, the obtained images were still excellent in quality.

The initial charge quantity of the toner, measured by the blow-off method, was −21.3 μC/g. After the making of 200,000 copies, the charge quantity of the toner was −20.2 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

COMPARATIVE EXAMPLE 2

The same procedure for preparing the two-component type developer as employed in Example 2 was repeated except that 2 parts by weight of the aromatic fluoride (I)-2 in the formulation of the toner in Example 2 was replaced by 1.5 parts by weight of a commercially available metal-containing monoazo dye, "S-34" (Trademark), made by Orient Chemical Industries, Ltd., whereby a comparative developer was obtained.

The thus obtained comparative developer was subjected to the same image formation test as conducted in Example 2. The initial images obtained by the above test were clear free from fogging. After 10,000 copies were made, however, obtained images became unclear and fogging was observed. In addition, there was a film of the toner formed on the photoconductor.

The initial charge quantity of the toner, measured by the same method as employed in Example 2, was −9.2 μC/g. After the making of 50,000 copies, the charge quantity of the toner was decreased to −4.5 μC/g.

As a result of the image formation test under the conditions of high humidity of 90% RH at 35° C., the image density of obtained images was as low as 0.86 and images were unclear due to the fogging.

EXAMPLE 4

The following components were mixed and stirred in a Henschel mixer, and then kneaded for about 30 minutes in a roll mill which was heated to 130° to 140° C. This mixture was cooled to room temperature, pulverized and classified, so that black toner No. 4 with a particle diameter of 5 to 25 μm according to the present invention was obtained.

| | Parts by Weight |
|---|---|
| Styrene-n-butyl acrylate copolymer | 100 |
| Polypropylene | 5 |
| Carbon black | 10 |
| Aromatic fluoride (I)-6 | 1.5 |

100 parts by weight of the above prepared toner No. 4, 2.5 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear black. Even after 50,000 copies were made, the obtained images were still excellent in quality.

The initial charge quantity (Q/M) of the toner, measured by use of a specific charge quantity measuring apparatus, was −9.5 μC/g. After the making of 50,000 copies, the charge quantity of the toner was −8.2 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLES 5 TO 8

The same procedure for preparing the two-component type developer as employed in Example 1 was repeated except that the toner composition employed in Example 1 was replaced by the respective toner compositions as shown in Table 1, so that toners No. 5 to No. 8 according to the present invention were obtained.

2.5 parts by weight of each of the toners No. 5 to No. 8 and 97.5 parts by weight of the respective carrier particles as shown in Table 1 were mixed in a ball mill, whereby two-component type developers were separately obtained.

The thus obtained developers were subjected to the same image formation test as conducted in Example 1. The results are given in Table 1.

TABLE 1

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| 5 | Toner Composition | | | | | |
| | Polyethylene wax | 62 | Clear blue | Almost the same as that in initial stage | −18.9 | −18.2 |
| | Ethylene-vinyl acetate copolymer | 40 | | | | |
| | C.I. Pigment Blue 15 | 4 | | | | |
| | Aromatic fluoride (I)-1 | 2 | | | | |
| | Carrier Composition | | | | | |
| | Silicone-resin-coated ferrite | | | | | |
| 6 | Toner Composition | | | | | |
| | Polyester resin | 75 | Clear black | Same as the above | −19.5 | −19.1 |
| | Polypropylene | 5 | | | | |
| | Carbon black | 10 | | | | |
| | Aromatic fluoride (I)-3 | 2 | | | | |
| | Carrier Composition | | | | | |
| | Silicone-resin-coated ferrite | | | | | |

TABLE 1-continued

| Example No. | Formulation of Developer | Parts by Weight | Image Quality Initial Stage | Image Quality After 200,000 copies | Charge Quantity of Toner [μC/g] Initial Stage | Charge Quantity of Toner [μC/g] After 200,000 copies |
|---|---|---|---|---|---|---|
| 7 | Toner Composition | | | | | |
| | Styrene-n-butyl acrylate copolymer | 80 | Clear yellow | Same as the above | −17.8 | −17.2 |
| | Polyethylene | 10 | | | | |
| | C.I. Disperse Yellow 33 | 5 | | | | |
| | Aromatic fluoride (I)-8 | 2 | | | | |
| | Carrier Composition | | | | | |
| | Silicone-resin-coated ferrite | | | | | |
| 8 | Toner Composition | | | | | |
| | Styrene-n-butyl acrylate copolymer | 85 | Clear green | Same as the above | −23.4 | −22.1 |
| | Polypropylene | 5 | | | | |
| | C.I. Pigment Blue 15 | 5 | | | | |
| | C.I. Pigment Yellow 17 | 3 | | | | |
| | Aromatic fluoride (I)-12 | 2 | | | | |
| | Carrier Composition | | | | | |
| | Iron oxide powder | | | | | |

EXAMPLE 9

The same procedure for preparing the toner as employed in Example 1 was repeated except that the aromatic fluoride (I)-1 in the formulation of the toner in Example 1 was replaced by aromatic fluoride (II)-1, whereby blue toner No. 9 according to the present invention was obtained.

2.5 parts by weight of the above prepared toner No. 9 and 97.5 parts by weight of silicone-resin-coated ferrite carrier particles having a particle size of 100 to 250 meshes were mixed in a ball mill, whereby a two-component type developer was obtained.

The thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −18.8 μC/g. After the making of 200,000 copies, the charge quantity of the toner was −18.3 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 10

The same procedure for preparing the toner as employed in Example 2 was repeated except that the aromatic fluoride (I)-2 in the formulation of the toner in Example 2 was replaced by aromatic fluoride (II)-2, whereby red toner No. 10 according to the present invention was obtained.

100 parts by weight of the above prepared toner No. 10, 3 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear red. Even after 50,000 copies were made, the obtained images were still excellent in quality.

The initial charge quantity (Q/M) of the toner, measured by use of a specific charge quantity measuring apparatus, was −11.2 μC/g. After the making of 50,000 copies, the charge quantity of the toner was −10.5 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 11

The same procedure for preparing the toner as employed in Example 3 was repeated except that the aromatic fluoride (I)-5 in the formulation of the toner in Example 3 was replaced by aromatic fluoride (II)-5, whereby green toner No. 11 according to the present invention was obtained.

3.5 parts by weight of the above prepared toner No. 11 and 96.5 parts by weight of iron carrier particles having a particle size of 100 to 200 meshes were mixed in a ball mill, whereby a two-component type developer was obtained.

The thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −21.7 μC/g. After the making of 200,000 copies, the charge quantity of the toner was −20.2 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 12

The same procedure for preparing the toner as employed in Example 4 was repeated except that the aromatic fluoride (I)-6 in the formulation of the toner in Example 4 was replaced by aromatic fluoride (II)-6, whereby black toner No. 12 according to the present invention was obtained.

100 parts by weight of the above prepared toner No. 12, 2.5 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear black. Even after 50,000 copies were made, the obtained images were still excellent in quality.

The initial charge quantity (Q/M) of the toner, measured by use of a specific charge quantity measuring apparatus, was −11.9 μC/g. After the making of 50,000 copies, the charge quantity of the toner was −10.1 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLES 13 TO 16

The same procedure for preparing the two-component type developer as employed in Example 9 was repeated except that the toner composition employed in Example 9 was replaced by the respective toner compositions as shown in Table 2, so that toners No. 13 to No. 16 according to the present invention were obtained.

2.5 parts by weight of each of the toners No. 13 to No. 16 and 97.5 parts by weight of the respective carrier particles as shown in Table 2 were mixed in a ball mill, whereby two-component type developers were separately obtained.

The thus obtained developers were subjected to the same image formation test as conducted in Example 1. The results are given in Table 2.

TABLE 2

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| 13 | Toner Composition | | | | | |
| | Polyethylene wax | 62 | Clear blue | Almost the same as that in initial stage | −17.5 | −16.8 |
| | Ethylene-vinyl acetate copolymer | 40 | | | | |
| | C.I. Pigment Blue 15 | 4 | | | | |
| | Aromatic fluoride (II)-1 | 2 | | | | |
| | Carrier Composition | | | | | |
| | Silicone-resin-coated ferrite | | | | | |
| 14 | Toner Composition | | | | | |
| | Polyester resin | 75 | Clear black | Same as the above | −23.1 | −21.7 |
| | Polypropylene | 5 | | | | |
| | Carbon black | 10 | | | | |
| | Aromatic fluoride (II)-3 | 2 | | | | |
| | Carrier Composition | | | | | |
| | Iron oxide powder | | | | | |
| 15 | Toner Composition | | | | | |
| | Styrene-n-butyl acrylate copolymer | 80 | Clear yellow | Same as the above | −19.0 | −18.4 |
| | Polyethylene | 10 | | | | |
| | C.I. Disperse Yellow 33 | 5 | | | | |
| | Aromatic fluoride (II)-8 | 2 | | | | |
| | Carrier Composition | | | | | |
| | Silicone-resin-coated ferrite | | | | | |
| 16 | Toner Composition | | | | | |
| | Styrene-n-butyl acrylate copolymer | 83.5 | Clear green | Same as the above | −16.8 | −16.3 |
| | Polypropylene | 5 | | | | |
| | C.I. Pigment Blue 15 | 5 | | | | |
| | C.I. Pigment Yellow 17 | 3 | | | | |
| | Aromatic fluoride (II)-12 | 2.5 | | | | |
| | Carrier Composition | | | | | |
| | Iron oxide powder | | | | | |

EXAMPLE 17

The same procedure for preparing the toner as employed in Example 1 was repeated except that the aromatic fluoride (I)-1 in the formulation of the toner in Example 1 was replaced by aromatic fluoride (III)-1, whereby blue toner No. 17 according to the present invention was obtained.

2.5 parts by weight of the above prepared toner No. 17 and 97.5 parts by weight of silicone-resin-coated ferrite carrier particles having a particle size of 100 to 250 meshes were mixed in a ball mill, whereby a two-component type developer was obtained.

The thus obtained developer was subjected to the same image formation test as conducted in Example 1. The initial images obtained by the above test were clear.

Even after 200,000 copies were made, the obtained images were still excellent in quality.

The initial charge quantity of the toner, measured by the blow-off method, was −17.5 μC/g. After the making of 200,000 copies, the charge quantity of the toner was −16.3 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 18

The same procedure for preparing the toner as employed in Example 2 was repeated except that the aromatic fluoride (I)-2 in the formulation of the toner in Example 2 was replaced by aromatic fluoride (III)-2, whereby red toner No. 18 according to the present invention was obtained.

100 parts by weight of the above prepared toner No. 18, 3 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear red. Even after 50,000 copies were made, the obtained images were still excellent in quality.

The initial charge quantity (Q/M) of the toner, measured by use of a specific charge quantity measuring apparatus, was −11.8 μC/g. After the making of 50,000 copies the charge quantity of the toner was −10.4 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 19

The same procedure for preparing the toner as employed in Example 3 was repeated except that the aromatic fluoride (I)-5 in the formulation of the toner in Example 3 was replaced by aromatic fluoride (III)-5, whereby green toner No. 19 according to the present invention was obtained.

3.5 parts by weight of the above prepared toner No. 19 and 96.5 parts by weight of iron carrier particles having a particle size of 100 to 200 meshes were mixed in a ball mill, whereby a two-component type developer was obtained.

The thus obtained developer was subjected to the same image formation test as conducted in Example 1. The initial images obtained by the above test were clear.

Even after 200,000 copies were made, the obtained images were still excellent in quality.

The initial charge quantity of the toner, measured by the blow-off method, was −16.7 μC/g. After the making of 200,000 copies, the charge quantity of the toner was −16.2 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 20

The same procedure for preparing the toner as employed in Example 4 was repeated except that the aromatic fluoride (I)-6 in the formulation of the toner in Example 4 was replaced by aromatic fluoride (III)-6, whereby black toner No. 20 according to the present invention was obtained.

100 parts by weight of the above prepared toner No. 20, 2.5 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear black. Even after 50,000 copies were made, the obtained images were still excellent in quality.

The initial charge quantity (Q/M) of the toner, measured by use of a specific charge quantity measuring apparatus, was −7.9 μC/g. After the making of 50,000 copies, the charge quantity of the toner was −6.4 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLES 21 TO 24

The same procedure for preparing the two-component type developer as employed in Example 17 was repeated except that the toner composition employed in Example 17 was replaced by the respective toner compositions as shown in Table 3, so that toners No. 21 to No. 24 according to the present invention were obtained.

2.5 parts by weight of each of the toners No. 21 to No. 24 and 97.5 parts by weight of the respective carrier particles as shown in Table 3 were mixed in a ball mill, whereby two-component type developers were separately obtained.

The thus obtained developers were subjected to the same image formation test as conducted in Example 1. The results are given in Table 3.

TABLE 3

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| 21 | Toner Composition | | | | | |

TABLE 3-continued

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| | Polyethylene wax | 62 | Clear blue | Almost the same as that in initial stage | −18.5 | −17.2 |
| | Ethylene-vinyl acetate copolymer | 40 | | | | |
| | C.I. Pigment Blue 15 | 4 | | | | |
| | Aromatic fluoride (III)-1 | 2 | | | | |
| | Carrier Composition | | | | | |
| | Silicone-resin-coated ferrite | | | | | |
| 22 | Toner Composition | | | | | |
| | Polyester resin | 75 | Clear black | Same as the above | −19.1 | −18.4 |
| | Polypropylene | 5 | | | | |
| | Carbon black | 10 | | | | |
| | Aromatic fluoride (III)-3 | 2 | | | | |
| | Carrier Composition | | | | | |
| | Iron oxide powder | | | | | |
| 23 | Toner Composition | | | | | |
| | Styrene-n-butyl acrylate copolymer | 80 | Clear yellow | Same as the above | −16.3 | −15.6 |
| | Polyethylene | 10 | | | | |
| | C.I. Disperse Yellow 33 | 5 | | | | |
| | Aromatic fluoride (III)-8 | 2 | | | | |
| | Carrier Composition | | | | | |
| | Silicone-resin-coated ferrite | | | | | |
| 24 | Toner Composition | | | | | |
| | Styrene-n-butyl acrylate copolymer | 85 | Clear green | Same as the above | −22.5 | −20.8 |
| | Polypropylene | 5 | | | | |
| | C.I. Pigment Blue 15 | 5 | | | | |
| | C.I. Pigment Yellow 17 | 3 | | | | |
| | Aromatic fluoride (III)-12 | 2 | | | | |
| | Carrier Composition | | | | | |
| | Iron oxide powder | | | | | |

EXAMPLE 25

The same procedure for preparing the toner as employed in Example 1 was repeated except that the aromatic fluoride (I)-1 in the formulation of the toner in Example 1 was replaced by aromatic fluoride (IV)-1, whereby blue toner No. 25 according to the present invention was obtained.

2.5 parts by weight of the above prepared toner No. 25 and 97.5 parts by weight of silicone-resin-coated ferrite carrier particles having a particle size of 100 to 250 meshes were mixed in a ball mill, whereby a two-component type developer was obtained.

The thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −19.6 μC/g. After the making of 200,000 copies, the charge quantity of the toner was −18.7 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 26

The same procedure for preparing the toner as employed in Example 2 was repeated except that the aromatic fluoride (I)-2 in the formulation of the toner in Example 2 was replaced by aromatic fluoride (IV)-2, whereby red toner No. 26 according to the present invention was obtained.

100 parts by weight of the above prepared toner No. 26, 3 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear red. Even after 50,000 copies were made, the obtained images were still excellent in quality.

The initial charge quantity (Q/M) of the toner, measured by use of a specific charge quantity measuring apparatus, was −12.3 μC/g. After the making of 50,000 copies, the charge quantity of the toner was −11.7 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 27

The same procedure for preparing the toner as employed in Example 3 was repeated except that 1.5 parts by weight of the aromatic fluoride (I)-5 in the formulation of the toner in Example 3 was replaced by 1 part by weight of aromatic fluoride (IV)-5, whereby green toner No. 27 according to the present invention was obtained.

3.5 parts by weight of the above prepared toner No. 27 and 96.5 parts by weight of iron carrier particles having a particle size of 100 to 200 meshes were mixed in a ball mill, whereby a two-component type developer was obtained.

The thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −17.8 μC/g. After the making of 200,000 copies, the charge quantity of the toner was −17.2 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 28

The same procedure for preparing the toner as employed in Example 4 was repeated except that the aromatic fluoride (I)-6 in the formulation of the toner in Example 4 was replaced by aromatic fluoride (IV)-6, whereby black toner No. 28 according to the present invention was obtained.

100 parts by weight of the above prepared toner No. 28, 2.5 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear black. Even after 50,000 copies were made, the obtained images were still excellent in quality.

The initial charge quantity (Q/M) of the toner, measured by use of a specific charge quantity measuring apparatus, was −13.1 μC/g. After the making of 50,000 copies, the charge quantity of the toner was −11.7 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLES 29 TO 32

The same procedure for preparing the two-component type developer as employed in Example 25 was repeated except that the toner composition employed in Example 25 was replaced by the respective toner compositions as shown in Table 4, so that toners No. 29 to No. 32 according to the present invention were obtained.

2.5 parts by weight of each of the toners No. 29 to No. 32 and 97.5 parts by weight of the respective carrier particles as shown in Table 4 were mixed in a ball mill, whereby two-component type developers were separately obtained.

The thus obtained developers were subjected to the same image formation test as conducted in Example 1. The results are given in Table 4.

TABLE 4

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| 29 | Toner Composition | | | | | |
| | Polyethylene wax | 62 | Clear blue | Almost the same as that in initial stage | −18.2 | −17.1 |
| | Ethylene-vinyl acetate copolymer | 40 | | | | |
| | C.I. Pigment Blue 15 | 4 | | | | |
| | Aromatic fluoride (IV)-1 | 2 | | | | |
| | Carrier Composition | | | | | |
| | Silicone-resin-coated ferrite | | | | | |
| 30 | Toner Composition | | | | | |
| | Polyester resin | 75 | Clear black | Same as the above | −19.6 | −19.0 |
| | Polypropylene | 5 | | | | |
| | Carbon black | 10 | | | | |
| | Aromatic fluoride (IV)-3 | 2 | | | | |
| | Carrier Composition | | | | | |
| | Iron oxide powder | | | | | |
| 31 | Toner Composition | | | | | |
| | Styrene-n-butyl acrylate copolymer | 80 | Clear yellow | Same as the above | −17.8 | −17.3 |
| | Polyethylene | 10 | | | | |
| | C.I. Disperse Yellow 33 | 5 | | | | |
| | Aromatic fluoride (IV)-8 | 2 | | | | |
| | Carrier Composition | | | | | |
| | Silicone-resin-coated ferrite | | | | | |
| 32 | Toner Composition | | | | | |
| | Styrene-n-butyl acrylate copolymer | 85 | Clear green | Same as the above | −20.6 | −19.7 |
| | Polypropylene | 5 | | | | |
| | C.I. Pigment Blue 15 | 5 | | | | |
| | C.I. Pigment Yellow 17 | 3 | | | | |
| | Aromatic fluoride (IV)-12 | 2 | | | | |

TABLE 4-continued

| Example No. | Formulation of Developer | Parts by Weight | Image Quality Initial Stage | Image Quality After 200,000 copies | Charge Quantity of Toner [μC/g] Initial Stage | Charge Quantity of Toner [μC/g] After 200,000 copies |
|---|---|---|---|---|---|---|
| | Carrier Composition | | | | | |
| | Iron oxide powder | | | | | |

EXAMPLE 33

The following components were mixed and stirred in a Henschel mixer, and then kneaded for about 30 minutes in a roll mill which was heated to 130° to 140° C. This mixture was cooled to room temperature, pulverized and classified, so that blue toner No. 33 with a particle diameter of 5 to 20 μm according to the present invention was obtained.

| | Parts by Weight |
|---|---|
| Styrene-n-butyl methacrylate copolymer | 100 |
| Polypropylene | 5 |
| C.I. Pigment Blue 15 | 5 |
| Aromatic fluoride (V)-1 | 1.5 |

2.5 parts by weight of the above prepared toner No. 33 and 97.5 parts by weight of silicone-resin-coated ferrite carrier particles having a particle size of 100 to 250 meshes were mixed in a ball mill, whereby a two-component type developer was obtained.

Thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −18.6 μC/g. After the making of 200,000 copies, the charge quantity of the toner was −17.8 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 34

The same procedure for preparing the toner as employed in Example 2 was repeated except that the aromatic fluoride (I)-2 in the formulation of the toner in Example 2 was replaced by aromatic fluoride (V)-2, whereby red toner No. 34 according to the present invention was obtained.

100 parts by weight of the above prepared toner No. 34, 3 parts by weight of silicon carbide having a particle diameter of 2 μm and 0.1 parts by weight of hydrophobic colloidal silica were mixed and stirred in a speed kneader, whereby a one-component type developer was obtained.

The thus obtained developer was subjected to the same image formation test as conducted in Example 2.

The initial images obtained by the above test were clear red. Even after 50,000 copies were made, the obtained images were still excellent in quality.

The initial charge quantity (Q/M) of the toner, measured by use of a specific charge quantity measuring apparatus, was −11.2 μC/g. After the making of 50,000 copies, the charge quantity of the toner was −10.5 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 35

The same procedure for preparing the toner as employed in Example 3 was repeated except that the aromatic fluoride (I)-5 in the formulation of the toner in Example 3 was replaced by aromatic fluoride (V)-5, whereby green toner No. 35 according to the present invention was obtained.

3.5 parts by weight of the above prepared toner No. 35 and 96.5 parts by weight of iron carrier particles having a particle size of 100 to 200 meshes were mixed in a ball mill, whereby a two-component type developer was obtained.

The thus obtained developer was subjected to the same image formation test as conducted in Example 1. The initial images obtained by the above test were clear. Even after 200,000 copies were made, the obtained images were still excellent in quality.

The initial charge quantity of the toner, measured by the blow-off method, was −18.1 μC/g. After the making of 200,000 copies, the charge quantity of the toner was −17.7 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLE 36

The following components were mixed and stirred in a Henschel mixer, and then kneaded for about 30 minutes in a roll mill which was heated to 130° to 140° C. This mixture was cooled to room temperature, pulverized and classified, so that black toner No. 36 with a particle diameter of 5 to 25 μm according to the present invention was obtained.

| | Parts by Weight |
|---|---|
| Unsaturated polyester | 100 |
| Polypropylene | 5 |
| Carbon black | 10 |
| Aromatic fluoride (V)-6 | 1.5 |

100 parts by weight of the above prepared toner No. 36, 2.5 parts by weight of silicon carbide having a particle diameter of 2 μm and 0.1 parts by weight of hydrophobic collodial silica were mixed and stirred in a speed kneader, whereby a one-component type developer was obtained.

The thus obtained developer was subjected to the same image formation test as conducted in Example 2.

2.5 parts by weight of each of the toners No. 37 to No. 40 and 97.5 parts by weight of the respective carrier particles as shown in Table 5 were mixed in a ball mill, whereby two-component type developers were separately obtained.

The thus obtained developers were subjected to the same image formation test as conducted in Example 1. The results are given in Table 5.

TABLE 5

| Example No. | Formulation of Developer | Parts by Weight | Image Quality: Initial Stage | Image Quality: After 200,000 copies | Charge Quantity of Toner [μC/g]: Initial Stage | Charge Quantity of Toner [μC/g]: After 200,000 copies |
|---|---|---|---|---|---|---|
| 37 | Toner Composition | | | | | |
| | Polyethylene wax | 62 | Clear blue | Almost the same as that in initial stage | −19.7 | −19.2 |
| | Ethylene-vinyl acetate copolymer | 40 | | | | |
| | C.I. Pigment Blue 15 | 4 | | | | |
| | Aromatic fluoride (V)-1 | 2 | | | | |
| | Carrier Composition | | | | | |
| | Silicone-resin-coated ferrite | | | | | |
| 38 | Toner Composition | | | | | |
| | Polyester resin | 75 | Clear black | Same as the above | −19.3 | −18.9 |
| | Polypropylene | 5 | | | | |
| | Carbon black | 10 | | | | |
| | Aromatic fluoride (V)-3 | 2 | | | | |
| | Carrier Composition | | | | | |
| | Iron oxide powder | | | | | |
| 39 | Toner Composition | | | | | |
| | Styrene-n-butyl acrylate copolymer | 80 | Clear yellow | Same as the above | −20.8 | −20.3 |
| | Polyethylene | 10 | | | | |
| | C.I. Disperse Yellow 33 | 5 | | | | |
| | Aromatic fluoride (V)-8 | 2 | | | | |
| | Carrier Composition | | | | | |
| | Silicone-resin-coated ferrite | | | | | |
| 40 | Toner Composition | | | | | |
| | Styrene-n-butyl acrylate copolymer | 83.5 | Clear green | Same as the above | −20.6 | −19.7 |
| | Polypropylene | 5 | | | | |
| | C.I. Pigment Blue 15 | 5 | | | | |
| | C.I. Pigment Yellow 17 | 3 | | | | |
| | Aromatic fluoride (V)-12 | 2.5 | | | | |
| | Carrier Composition | | | | | |
| | Iron oxide powder | | | | | |

The initial images obtained by the above test were clear black. Even after 50,000 copies were made, the obtained images were still excellent in quality.

The initial charge quantity (Q/M) of the toner, measured by use of a specific charge quantity measuring apparatus, was −10.9 μC/g. After the making of 50,000 copies, the charge quantity of the toner was −10.3 μC/g, which was almost the same as the initial charge quantity of the toner.

In addition, under the conditions of high humidity of 90% RH at 35° C., and low humidity of 15% RH at 10° C., the image quality of the obtained images was not deteriorated. The film forming of the toner on the photoconductor was not observed.

EXAMPLES 37 TO 40

The same procedure for preparing the two-component type developer as employed in Example 33 was repeated except that the toner composition employed in Example 33 was replaced by the respective toner compositions as shown in Table 5, so that toners No. 37 to No. 40 according to the present invention were obtained.

As can be seen from the above, the toners for developing a latent electrostatic image to a visible toner image according to the present invention comprises a specific charge controlling agent selected from the group consisting of aromatic fluorides having formulas (I) through (V). As a result, the negatively charged triboelectric performance can be kept constant, and the image quality after repeated copying operations is thus similarly excellent to that of the initial stage.

In addition to the above, the toner according to the present invention is superior to conventional toners in the dispersibility of the charge controlling agent in the binder resin. Accordingly, the environmental stability of the toner according to the present invention was excellent and it can produce a clear color image.

What is claimed is:

1. A toner for developing latent electrostatic images comprising a coloring agent, a binder resin component and a negative charge controlling agent which is selected from the group consisting of:

(i) an aromatic fluoride having formula (I):

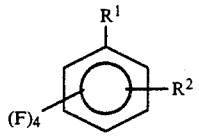

(I)

wherein $R^1$ represents COOH group, CN group, F, Cl, $CONH_2$ group or $NHCOCH_3$ group; and $R^2$ represents H, OH group, $NH_2$ group, CN group, COOH group or Cl;

(ii) an aromatic fluoride having formula (II):

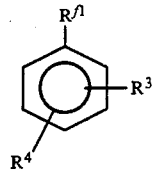

(II)

wherein $R^{f1}$ represents $C_nF_{2n+1}$ or $OC_nF_{2n+1}$, in which n is a positive integer; and $R^3$ and $R^4$ each represent H, Cl, Br, COOH group, $NH_2$ group, $CONH_2$ group, $CONH(CH_2)_2CH_3$ group, $NHCOCH_3$ group, CN group or $NO_2$ group;

(iii) an aromatic fluoride having formula (III):

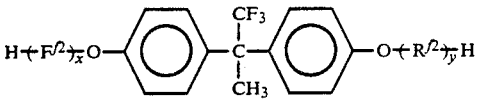

(III)

wherein $R^{f2}$ represents $C_nF_{2n}$, $OC_nF_{2n}$, $C_nH_{2n}$ or $OC_nH_{2n}$, in which n is a positive integer; and X and Y each represent a positive integer or zero;

(iv) an aromatic fluoride having formula (IV):

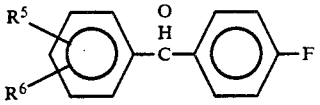

(IV)

wherein $R^5$ represents H, Cl, Br, F, COOH, an alkyl group having 1 to 8 carbon atoms, a perfluoroalkyl group having 1 to 8 carbon atoms or a perfluoroalkoxyl group having 1 to 8 carbon atoms; and $R^6$ represents H, Cl, Br, a halogenated alkyl group having 1 to 8 carbon atoms, $NO_2$ or CN.

2. The toner for developing latent electrostatic images as claimed in claim 1, wherein said negative charge controlling agent is an aromatic fluoride having formula (I):

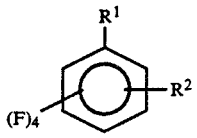

(I)

wherein $R^1$ represents COOH group, CN group, F, Cl, $CONH_2$ group or $NHCOCH_3$ group; and $R^2$ represents H, OH group, $NH_2$ group, CN group, COOH group or Cl.

3. The toner for developing latent electrostatic images as claimed in claim 1, wherein said negative charge controlling agent is an aromatic fluoride having formula (II):

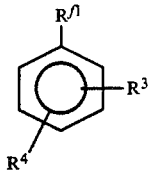

(II)

wherein $R^{f1}$ represents $C_nF_{2n+1}$ or $OC_nF_{2n+1}$, in which n is a positive integer; and $R^3$ and $R^4$ each represent H, Cl, Br, COOH group, $NH_2$ group, $CONH_2$ group, $CONH(CH_2)_2CH_3$ group, $NHCOCH_3$ group, CN group or $NO_2$ group.

4. The toner for developing latent electrostatic images as claimed in claim 1, wherein said negative charge controlling agent is an aromatic fluoride having formula (III):

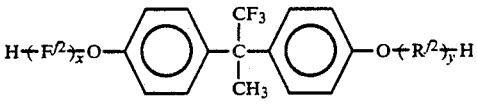

(III)

wherein $R^{f2}$ represents $C_nF_{2n}$, $OC_nF_{2n}$, $C_nH_{2n}$ or $OC_nH_{2n}$, in which n is a positive integer; and X and Y each represent a positive integer or zero.

5. The toner for developing latent electrostatic images as claimed in claim 1, wherein said negative charge controlling agent is an aromatic fluoride having formula (IV):

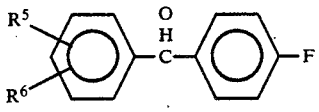

(IV)

wherein $R^5$ represents H, Cl, Br, F, COOH, an alkyl group having 1 to 8 carbon atoms, a perfluoroalkyl group having 1 to 8 carbon atoms or a perfluoroalkoxyl group having 1 to 8 carbon atoms; and $R^6$ represents H, Cl, Br, a halogenated alkyl group having 1 to 8 carbon atoms, $NO_2$ or CN.

6. The toner for developing latent electrostatic images as claimed in claim 2, wherein said aromatic fluoride having formula (I) is selected from the group consisting of:

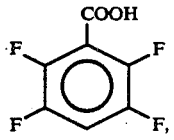

I-(1)

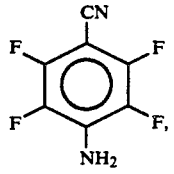

I-(2)

-continued
I-(3)
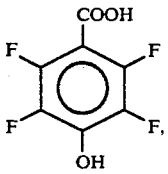
I-(4)
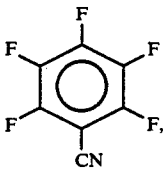
I-(5)
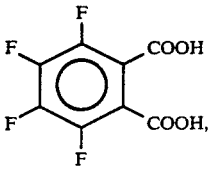
I-(6)
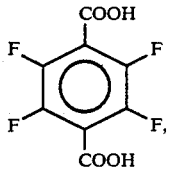
I-(7)
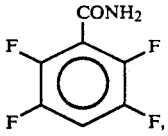
I-(8)
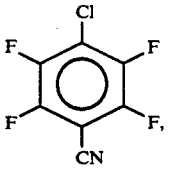
I-(9)
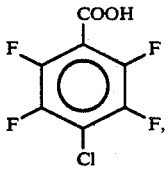
I-(10)
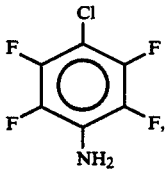
I-(11)
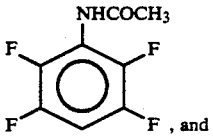
, and
-continued
I-(12)
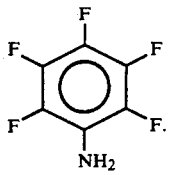
7. The toner for developing latent electrostatic images as claimed in claim 3, wherein said aromatic fluoride having formula (II) is selected from the group consisting of:
II-(1)
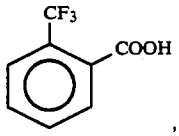
,
II-(2)
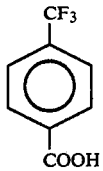
,
II-(3)
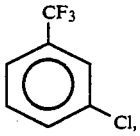
II-(4)
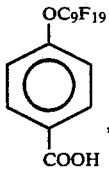
,
II-(5)
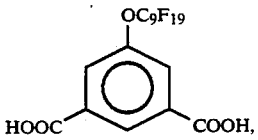
II-(6)
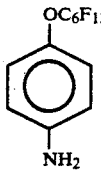
,
II-(7)
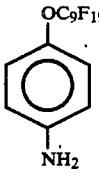
,
II-(8)
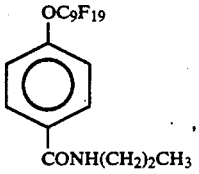
, -continued

II-(9)

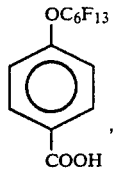

II-(10)

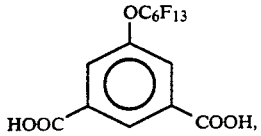

II-(11)

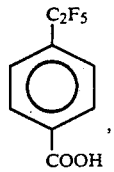

II-(12)

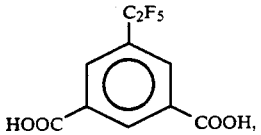

II-(13)

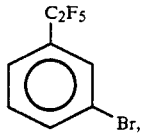

II-(14)

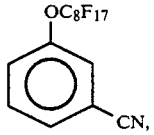

II-(15)

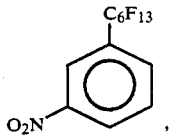

II-(16)

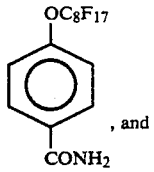

II-(17)

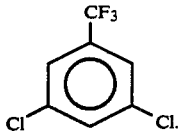

8. The toner for developing latent electrostatic images as claimed in claim 4, wherein said aromatic fluoride having formula (III) is selected from the group consisting of:

III-(1)

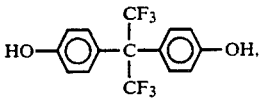

III-(2)

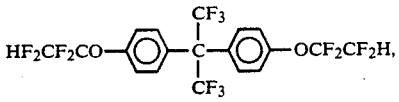

III-(3)

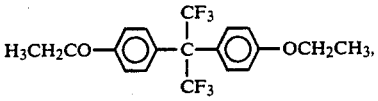

III-(4)

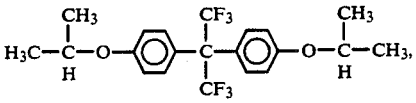

III-(5)

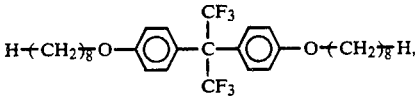

III-(6)

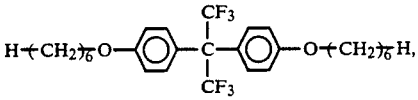

III-(7)

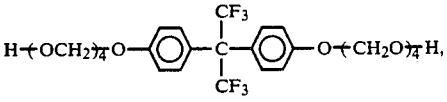

III-(8)

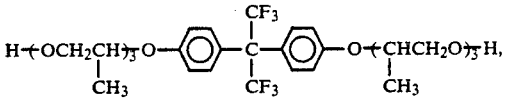

III-(9)

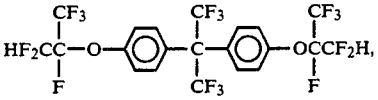

III-(10)

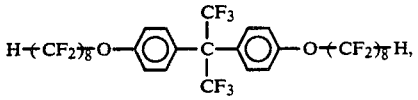

III-(11)

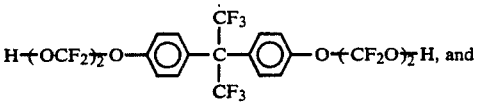

III-(12)

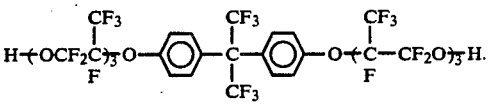

9. The toner for developing latent electrostatic images as claimed in claim 5, wherein said aromatic fluoride having formula (IV) is selected from the group consisting of:

IV-(1)

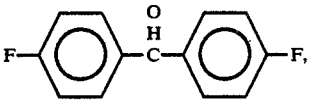

-continued

IV-(2)

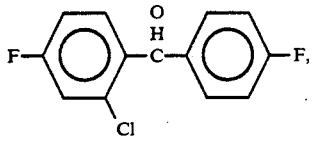

IV-(3)

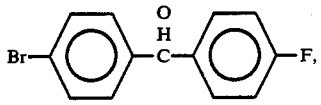

IV-(4)

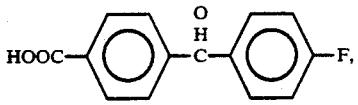

IV-(5)

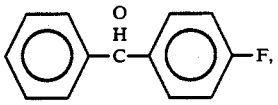

IV-(6)

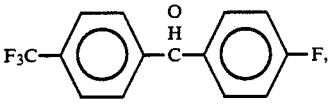

IV-(7)

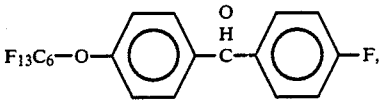

IV-(8)

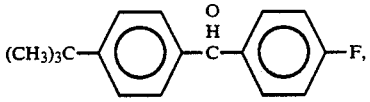

IV-(9)

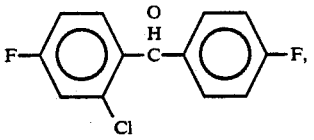

-continued

IV-(10)

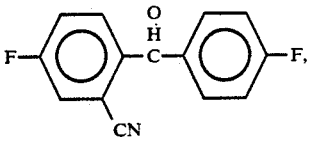

IV-(11)

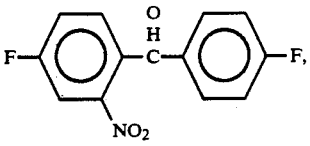

IV-(12)

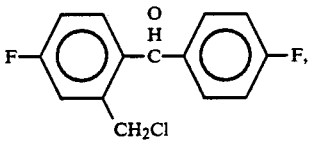

IV-(13)

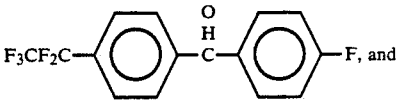

IV-(14)

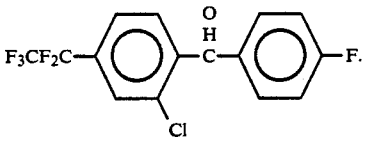

10. The toner for developing latent electrostatic images as claimed in claim 1, wherein the amount of said aromatic fluoride is in the range of 0.1 to 20 parts by weight to 100 parts by weight of said binder resin component.

11. The toner for developing latent electrostatic images as claimed in claim 1, further comprising a magnetic material.

12. The toner for developing latent electrostatic images as claimed in claim 11, wherein the amount of said magnetic material is in the range of about 20 to 200 parts by weight to 100 parts by weight of said binder resin component.

13. The toner for developing latent electrostatic images as claimed in claim 11, wherein said magnetic material has a particle size ranging from 0.1 to 2 $\mu$m.

14. The toner for developing latent electrostatic images as claimed in claim 1, further comprising carrier particles which are mixed with said toner to constitute a two-component type developer.

* * * * *